US007743969B2

(12) United States Patent
Bokel

(10) Patent No.: US 7,743,969 B2
(45) Date of Patent: Jun. 29, 2010

(54) CARTON WITH UPRIGHT HANDLE AND MULTI-PLY REINFORCED TOP WALL

(75) Inventor: Tom Von Bokel, Smithton, IL (US)

(73) Assignee: MeadWestvaco Packaging Systems, LLC, Glen Allen, VA (US)

( * ) Notice: Subject to any disclaimer, the term of this patent is extended or adjusted under 35 U.S.C. 154(b) by 864 days.

(21) Appl. No.: 11/421,020

(22) Filed: May 30, 2006

(65) Prior Publication Data

US 2006/0266812 A1 Nov. 30, 2006

Related U.S. Application Data

(60) Provisional application No. 60/686,230, filed on May 31, 2005.

(51) Int. Cl.
*B65D 5/46* (2006.01)
*B65D 65/00* (2006.01)
*B65D 75/00* (2006.01)

(52) U.S. Cl. ..... 229/117.14; 229/117.09; 229/117.12; 229/117.13; 229/117.15; 229/117.19; 229/117.22; 206/427; 206/429; 206/434

(58) Field of Classification Search ..... 229/117.14, 229/117.09, 117.12, 117.13, 117.15, 117.19, 229/117.22, 103.2, 103.3, 101; 206/427, 206/429, 434

See application file for complete search history.

(56) References Cited

U.S. PATENT DOCUMENTS 2,628,764 A 2/1953 Rubinstein et al.
2,663,485 A * 12/1953 Johnson ..... 229/117.15
2,842,304 A 7/1958 Ringler
2,849,112 A 8/1958 Forrer
2,863,598 A * 12/1958 Currie ..... 206/434
3,099,383 A * 7/1963 Redpath et al. ..... 229/117.13
3,178,242 A 4/1965 Ellis
3,197,116 A 7/1965 Zastrow
3,228,582 A 1/1966 Osberg
3,695,508 A * 10/1972 Hocking ..... 229/101
3,829,006 A 8/1974 Spiegel
4,195,765 A * 4/1980 Roccaforte et al. ..... 229/117.15
4,222,485 A 9/1980 Focke (Continued)

FOREIGN PATENT DOCUMENTS

EP 389254 A1 * 9/1990

(Continued)

*Primary Examiner*—Gary E Elkins
*Assistant Examiner*—Latrice Byrd

(57) ABSTRACT

A wrap-around style or end-loaded carton for enclosing articles such as cans in multiple rows is formed from a single blank of sheet material, and includes a three-ply top wall and an integrated composite handle that is centrally located so as to balance the load in the carton when the handle is raised to an upright position. The top wall includes an outer panel, and intermediate panel, and an inner top panel, each hingedly connected to another. The composite handle is struck from the outer panel and the intermediate panel and is liberated or partially detachable therefrom so as to be hingedly connected to the top wall, and rotatable to an upright position. When the handle is raised, at least a portion of each edge of the top wall is reinforced by at least one additional layer of carton material, and thus, is at least two plies thick.

31 Claims, 3 Drawing Sheets

U.S. PATENT DOCUMENTS

| | | | |
|---|---|---|---|
| 4,274,580 | A | 6/1981 | Arnold |
| 4,318,474 | A | 3/1982 | Hasegawa |
| 4,331,289 | A | 5/1982 | Killy |
| 4,398,636 | A | 8/1983 | Baxter |
| 4,470,539 | A | 9/1984 | Skillen |
| 4,482,090 | A | 11/1984 | Milliens |
| 4,566,593 | A | 1/1986 | Muller |
| 4,588,084 | A | 5/1986 | Holley, Jr. |
| 5,209,393 | A | 5/1993 | Xapelli |
| 5,284,294 | A | 2/1994 | Floyd |
| 5,328,081 | A | 7/1994 | Saulas |
| 5,699,957 | A | 12/1997 | Blin et al. |
| 6,168,027 | B1 | 1/2001 | Esser |
| 6,386,369 | B2 | 5/2002 | Yuhas et al. |
| 6,578,736 | B2 | 6/2003 | Spivey |
| 2003/0234285 | A1 | 12/2003 | Bates et al. |
| 2005/0085364 | A1 | 4/2005 | Spivey, Sr. |

FOREIGN PATENT DOCUMENTS

| | | |
|---|---|---|
| GB | 1 420 024 | 1/1976 |
| GB | 2 252 546 | 8/1992 |
| JP | 6-619116 | 9/1994 |

* cited by examiner

CARTON WITH UPRIGHT HANDLE AND MULTI-PLY REINFORCED TOP WALL

RELATED APPLICATIONS

This application claims priority to U.S. Application No. 60/686,230, filed May 31, 2005, the entirety of which is incorporated herein by reference.

TECHNICAL FIELD

This invention relates generally to cartons, and more particularly, to a carton having a multi-ply reinforced top wall with an upright handle.

BACKGROUND OF THE INVENTION

It is common for the weight of articles enclosed in a typical carton to exceed the strength of the handle provided for carrying the cartons. This is particularly so when the handle is integral to the top wall of the carton and when the burst strength of the material comprising that top wall is insufficient to avoid failure of the handle and the top wall itself. One approach to resolving this quandary is to construct the carton from a stronger material or from a sheet of material that is relatively thicker. As cartons typically have six walls (top, sides, bottom, and ends) that are formed from a single sheet of material, and cost tends to increase according to the strength and thickness of material used to construct the carton walls, this approach is an expensive one because it effectively amounts to reinforcing all of the walls of the carton irrespective of the relative magnitude of the forces borne by each wall.

According to another approach, additional material is applied to or around the handle as needed to reinforce its connection to the top wall. For instance, a racetrack style handle aperture may be reinforced by outlining its edges with an additional layer of sheet material. However, it is preferable to eliminate the need for additional assembly by forming a carton from a single sheet of material rather than attaching additional components to the carton blank.

What is needed is a carton that is formed from a single blank, and which provides a reinforced top wall with an integrated handle, where the carton walls are efficiently constructed without wasting expensive material in carton walls that are less likely to fail.

SUMMARY OF THE INVENTION

The various embodiments of the present invention overcome the shortcomings of the prior art by providing a paperboard or similarly constructed carton with a reinforced top wall that is formed from multiple at least partially overlapped or overlapping panels. In exemplary embodiments, the top wall includes an outer top panel comprising the uppermost layer of the top wall, an inner top panel comprising the lowermost layer of the top wall, and an intermediate top panel at least a portion of which is interposed between the outer and inner top panels. This arrangement yields a three ply top wall which is advantageously rigid. The corners along the edges of the top wall are reinforced by the multiple plies, thereby improving the weight bearing capacity of the top wall and preventing deformation that may be caused by forces such as loaded cartons or other items stacked atop the carton of the present invention.

As an added advantage, a composite handle is struck from the outer and the intermediate top panels and is hingedly connected to the top wall. The composite handle is partially detachable from the outer and intermediate panels and swivels to an upright position with respect to the plane of the top wall to provide an efficient and ergonomic means for carrying the carton. Because the composite handle is essentially doubled-over, its strength and the strength of the hinged connection to the top wall is sufficient to support the weight of the articles within the carton.

Before partially detaching the composite handle, the three top wall panels are generally coextensive, yielding the aforementioned three-ply top wall. When the composite handle is in its upright position, at least a portion of each of the corners underlying the four edges of the top wall are reinforced by at least two plies of material, with at least one corner being reinforced by three plies of material. This arrangement prevents the corners from buckling under the weight of articles such as cans or bottles enclosed by the carton, particularly when the carton is lifted by the upright handle. This arrangement also prevents the corners from downwardly buckling when the loaded carton is lifted by the handle.

The various features and benefits of the invention are particularly useful for implementation in a wrap-around style carton. The panels of the reinforced top wall can be pre-glued or otherwise secured together as described herein prior to delivering the carton blanks in a flattened condition to a facility for packaging products or other articles, where the finished package is formed by wrapping the carton around a group of articles and by securing the walls of the carton together. Thus, the composite handle and the reinforced top wall can advantageously be preformed prior to loading the carton.

Generally described, the invention provides a wrap-around style carton that is preferably formed from a single blank constructed of a foldable sheet material. The blank includes a plurality of panels that can be connected together to form the carton of the present invention. At least three of the panels are adjacent to one another. When the carton is erected, the panels cooperate to form carton walls for encasing a plurality of articles.

The erected carton has several walls, including at least the following: a bottom wall, side walls hingedly connected to opposing edges of the bottom wall, and a top wall. Although a substantially open-ended carton is contemplated, the exemplary carton also includes end walls that are formed at least in part from some combination of lower end wall panels hingedly connected to opposing edges of the bottom wall, side flaps, and upper end wall panels. The top wall is a reinforced composite of three at least partially overlapping panels, which may or may not be at least partially secured together in a face contacting arrangement. An inner top panel is hingedly connected to one of the side walls so as to form a corner between the first side wall and the top wall. An outer top panel is hingedly connected to a second side wall and to the end walls, thereby forming a second corner between the second side wall and the top wall, and forming third and fourth corners between the respective end walls and the top wall. An intermediate top panel hingedly connects the inner top panel to the outer top panel. The intermediate top panel is disposed between the inner top panel and the outer top panel in an accordion style configuration, thereby forming a three-ply top wall. A composite handle panel may be defined by a first handle panel formed in the intermediate panel and a second handle panel formed in the outer top panel. The two handle panels are hingedly connected along the fold line defining the hinged connection between the intermediate top panel and the outer top panel which, according to one aspect of the invention, extends substantially to the first corner. The hinged connection between the intermediate top panel and the inner top panel extends substantially to, or otherwise reinforces, the second corner. Thus, in certain embodiments, the length and width of the inner top panel are substantially the same as the length and width of the outer top panel. In certain other embodiments, the length and width of the inner top panel are simply sufficient to enable the edges of the inner top panel to support at least three of the four corners of the top wall, and may be trimmed somewhat so as to avoid obstructing the folds required to form the four corners between the top wall and the side and end walls. Similarly, in certain embodiments, at least a portion of the intermediate panel extends substantially to, or otherwise reinforces, the second, third, and fourth corners. In certain embodiments, at least a portion of one edge of the outer top panel extends substantially to, or otherwise reinforces, the first corner.

As mentioned above, the first handle panel is formed from the intermediate top panel, being defined in part by severance lines and by fold lines. In certain embodiments, severance lines extend partially across the intermediate top panel to the fold line between the outer top panel and the intermediate top panel. The second handle panel, hingedly connected to the first handle panel along the same fold line, is formed from the outer top panel. The second handle panel is similarly defined by severance lines extending partially across the outer top panel to the fold line between the outer top panel and the intermediate top panel.

According to another aspect of the invention, certain portions of the three layers of the top wall may be secured together so as to be laminated into a composite structure. The layers may be laminated by any suitable means for securing one layer of sheet material to another, including but not limited to glue, double sided tape, permanent and semi-permanent adhesives, magnets, non-permanent adhesives, hook and loop fasteners such as VELCRO® (which is a trademark registered to Velcro Industries B.V.), and the like.

More specifically described, the inside surface of the outer top panel may be secured to the inside surface of the intermediate panel in a face contacting relationship such that the inside surface of the first handle panel is secured to the inside surface of the second handle panel in a face contacting relationship, thereby forming a composite handle panel and reinforcing the second, third, and fourth corners. Similarly, at least a portion of the outside surface of the inner top panel may be secured to a portion of the outside surface of the intermediate top panel in a face contacting arrangement. At least one other portion of the inner top panel may be secured to the inside surface of the outer top panel in a face contacting arrangement at least in part to reinforce the first corner and to further support the third and fourth corners.

Lamination of the layers of the first corner may, according to one aspect, receive additional reinforcement by including two end wall tabs that are each hingedly connected to an opposing edge of the inner top panel. When the carton is erected, the outer surface of each end tab is secured to the inner surface of the end wall in a face contacting arrangement, at least in part to prevent delamination of the layers of the first corner.

To further reinforce its structure, the exemplary carton includes side flaps, each being hingedly connected to an edge of a side wall. In its erected condition, at least a portion of the outer surface of each side flap is secured to the inner surface of the end wall. More specifically, each side flap is directly or indirectly secured to the lower end wall panel and the upper end wall panel. The side flaps connected to the first side wall are hingedly connected to the end tabs via gussets, with the inside surface of at least a portion of each of the first and second gussets substantially contacting the inside surface of one of the end tabs in a face contacting arrangement, which may be secured in place. The side flaps connected to the second side wall are hingedly connected to the end wall via gussets, with the inside surface of at least a portion of each of these gussets substantially contacting the inside surface of the end wall in a face contacting arrangement, which may be secured in place. The outside surface of at least a portion of each of the gussets substantially contacts the outside surface of one of the side flaps in a face contacting arrangement, which may be secured in place.

The foregoing has broadly outlined some of the aspects and features of the present invention, which should be construed to be merely illustrative of various potential applications of the invention. Other beneficial results can be obtained by applying the disclosed information in a different manner or by combining the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
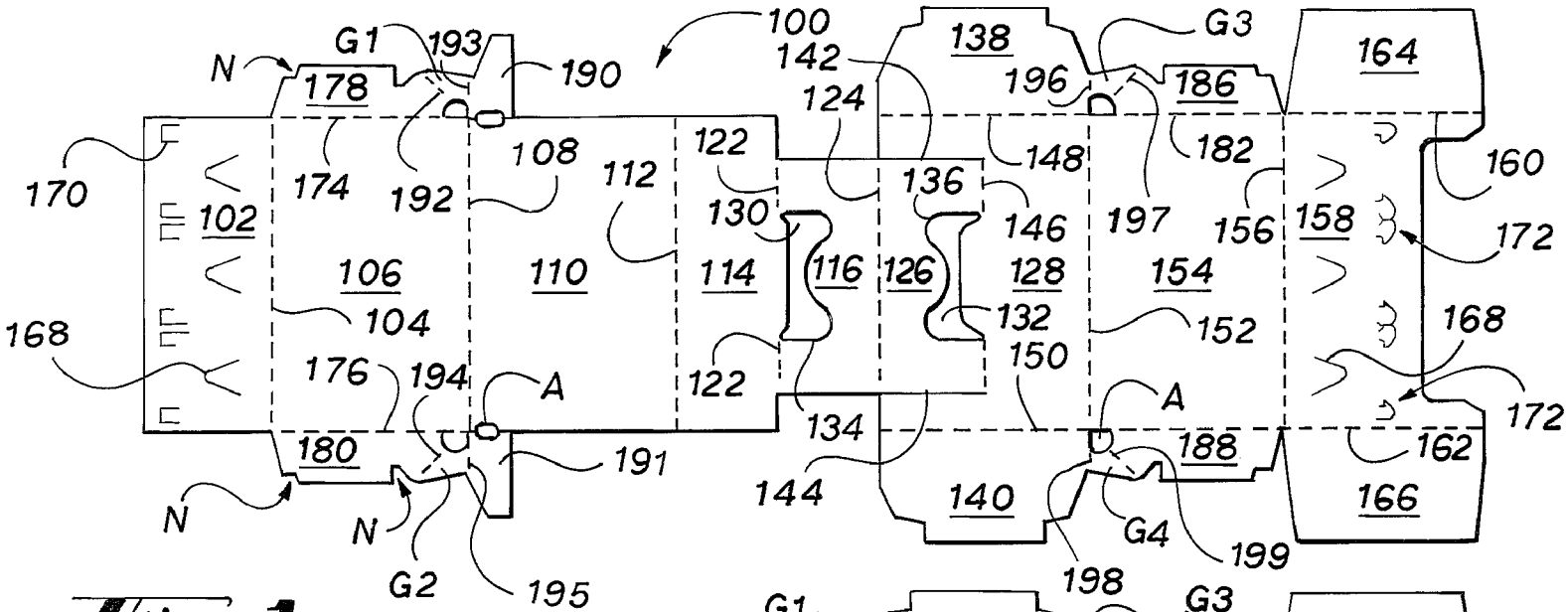
FIG. 1 is a plan view of a blank for forming the carton of the exemplary embodiment of the invention.

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as an illustration, specimen, model or pattern. The figures are not necessarily to scale and some features may be exaggerated or minimized to show details of particular components. In other instances, well-known components, systems, materials or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

Referring now to the drawings in which like numerals indicate like elements throughout the several views, the drawings illustrate certain of the various aspects of exemplary embodiments of a wrap-around style carton with a multi-ply top wall and upright handle, according to the present invention. In the embodiments described herein, the carton of the present invention is for enclosing, carrying, and dispensing articles such as beverage cans or bottles.

Generally described, and with reference to FIG. 1, the carton 300 (best shown in FIGS. 3 and 4) is formed from a blank 100 constructed from preferably a single piece of foldable sheet material such as paperboard, corrugated board, plastic, and the like. The outside surface of blank 100 is shown in the figure. The blank 100 includes several panels hingedly connected to one another and to various flaps and tabs to be described in more detail below.

More specifically, blank 100 includes a first bottom panel 102 that is hingedly connected along fold line 104 to a first side panel 106. The first side panel 106 is hingedly connected along fold line 108 to innertop panel 110. Inner top panel 110 is hingedly connected along fold line 112 to intermediate top panel 114. A first handle panel 116 is formed from intermediate top panel 114, and is defined by outer edges 118, 120, and by fold lines 122, 124. Fold line 122 provides a hinged connection that defines the axis of rotation of the first handle panel 116 with respect to the plane of the intermediate top panel 114; rotation occurs when the composite handle H is moved to its upright position (best shown in FIGS. 4 and 5). In the embodiment shown, the maximum width of the first handle panel 116, defined as the distance between outer edges 118, 120, is less than the overall width of the intermediate top panel 114. However, it is contemplated that the maximum width of the handle panel 116 may be at least as great as the overall width of the intermediate top panel 114. To facilitate nesting the intermediate top panel 114 beneath the outer top panel 128, the overall width of the intermediate top panel 114 may be at least slightly less that the width of the outer top panel 128, defined as the distance from fold line 148 to fold line 150. The outer edges 118, 120 may be contoured to taper or curve, or to include angled sections. The dimensions of the first handle panel 116 preferably mirror the dimensions of a second handle panel 126, which is formed from an outer top panel 128. The second handle panel 126 is hingedly connected to the outer top panel 128 along an interrupted fold line 146, and is hingedly connected to the first handle panel 116 along fold line 124. The second handle panel 126 is defined at least in part by severance lines 142, 144 that serve to define the outer edges of the second handle panel 126. The second handle panel 126 is further defined by fold line 146, which defines the axis of rotation about which the second handle panel 126 is rotated when the composite handle H is moved to its upright position (best shown in FIGS. 4 and 5). Severance lines 142, 144 may be pre-cut or may be any known or yet to be developed means for controllably severing sheet material, such as a frangible lines weakened by perforations, slits cuts, or half-cuts and the like, or any combination thereof, that facilitate tearing or breaking along a frangible line.

Fold lines 122 and 146 are, in the exemplary embodiments, substantially centrally located so as to yield a composite handle that distributes and balances the load generated by the articles within the carton.

Figure 3:
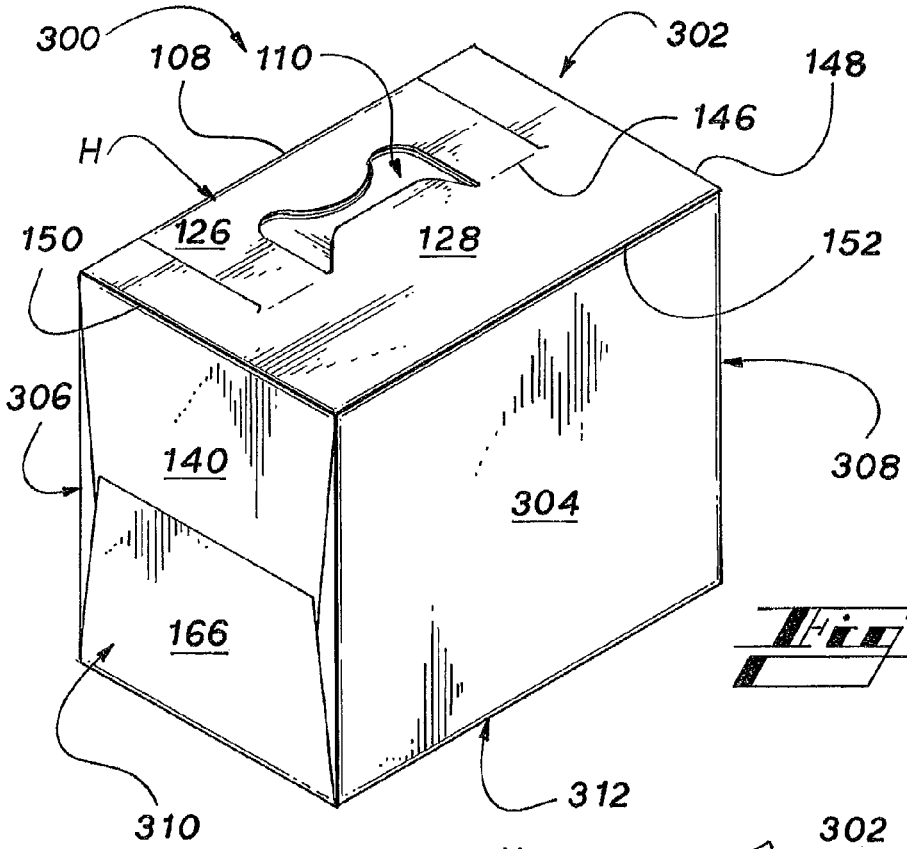
FIG. 3 is a perspective view of the exemplary carton formed from the blank of FIG. 1, showing the carton in a fully erected condition.
Figure 4:
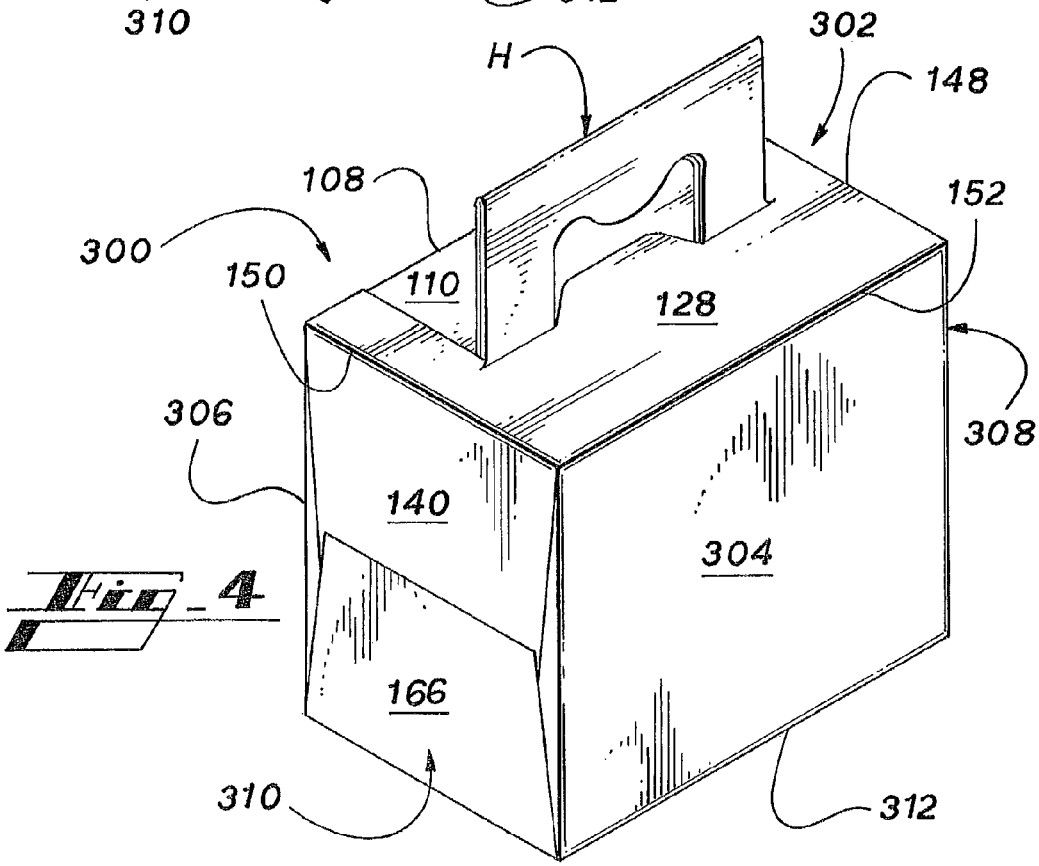
FIG. 4 is a perspective view of the carton of FIG. 3, with the composite handle raised to facilitate carrying the carton.

With particular reference to FIGS. 1 and 4, the handle panels 116, 126 include respective openings 130, 132 defined by edges 134, 136 that create a handhold in the composite handle H of the erected carton 300. Openings 130, 132 may be irregularly shaped, as defined by continuous edges 134, 136, in order to optimize the ergonomics of the handhold. The fold line 122 as best shown in FIG. 1 is interrupted by the opening 130. An optional protrusion 123 is formed along part of the edge 134 so as to protrude from the intermediate top panel 114 into the opening 130. Similarly, fold line 146 may be continued by or interrupted by the contours of the opening 132. An optional protrusion 147 is formed along part of the edge 136 to protrude from the outer top panel 128 into the opening 132. In the erected carton 300 (FIGS. 3 and 4), protrusions 123 and 147 may be secured together and secured to the inner top panel 110 to further strengthen the lamination of intermediate top panel 114 and outer top panel 128 to inner top panel 110 by extending across the axes of rotation of the handle panels 116, 126 that form the composite handle H.

Outer top panel 128 is hingedly connected at each of its end edges to a respective upper end wall panel 138, 140. The connections between the outer top panel 128 and upper end wall panels 138, 140 are defined by respective fold lines 148, 150. Outer top panel 128 is also hingedly connected along fold line 152 to a second side panel 154, which is hingedly connected along fold line 156 to a second bottom panel 158. Second bottom panel 158 is hingedly connected along folds lines 160, 162 to lower end wall panels 164, 166.

In the embodiment described herein, the bottom wall of the erected carton 300 is formed by mechanically securing the bottom panels 102, 158 together, although other means (e.g., adhesive) for securing are contemplated, including the examples listed above. To that end, the bottom panels 102, 158 include false apertures 168 to facilitate aligning retaining tabs 170 struck from first bottom panel 102 with locking tabs 172, which are struck from second bottom panel 158. The retaining tabs 170 and locking tabs 172 shown are well known to those skilled in the art as means for securing panels together, so these elements will not be described in great detail herein.

The first side panel 106 of the exemplary carton 300 is also hingedly connected at its end edges defined by fold lines 174, 176 to respective first and second side flaps 178, 180. Similarly, the second side panel 154 is hingedly connected at its end edges defined by fold lines 182, 184 to respective third and fourth side flaps 186, 188. Each side flap 178, 180, 186, 188 may include various notches N that are situated so as correspond to or avoid impeding the operation of certain parts of the packaging machine used to load and erect the carton.

Side flaps 178, 180, 186, 188 function at least in part to facilitate closing the end walls 308, 310 (FIGS. 3 and 4) of the carton once articles have been loaded into the carton 300 through one or both ends of the carton 300. In the embodiment shown, the end walls 308, 310 of the erected carton 300 are end wall closures comprising, at least in part, upper end wall panels 138, 140 and lower end wall panels 164, 166 that are secured together. However, it is contemplated that each end wall 308, 310 may be formed from a single upper end wall panel (not shown) with a single edge flap (not shown) that is secured to the bottom wall 312. Otherwise, each end wall 308, 310 may be formed from a single lower end wall panel (not shown) with a single edge flap (not shown) that is secured to the top wall 302. Furthermore, a carton that is essentially open-ended at one or both ends is also contemplated. Such a carton preferably includes means for retaining the articles in the carton to prevent undesirable release from the ends. Means for retaining might include any suitable combination of elements such as end wall panels, side flaps, gussets, edge flaps, retention walls, netting, straps, and the like. For example, the end wall panels 138, 140, 164, 166 in the exemplary embodiment may be significantly shorter such that they cannot overlap each other but instead cooperate with the side flaps 178, 180 to form a lip (not shown) around the periphery each open end of the carton 300. As an alternative, either the upper end wall panels 138, 140 or the lower end wall panels 164, 166 can be omitted altogether.

First and second side flaps 178, 180 are hingedly connected to end tabs 190, 191 via gussets G1, G2, respectively. The end tabs 190, 191 are hingedly connected to the inner top panel 110, respectively. The third and fourth side flaps 186, 188 are hingedly connected to the respective upper end wall panels 138, 140 via respective gussets G3, G4. The gussets G1, G2, G3, G4 are each defined at least in part by the respective pair of fold lines 192/193, 194/195, 196/197, 198/199. It is contemplated that each gusset G1, G2, G3, G4 may comprise more than one gusset panel.

At certain junctures, folds, intersections, and other locations on the blank 100, apertures (such as at A in FIG. 1), slits, or cutouts may be made to facilitate folding operations and minimize congestion of material at folds.

Figure 2:
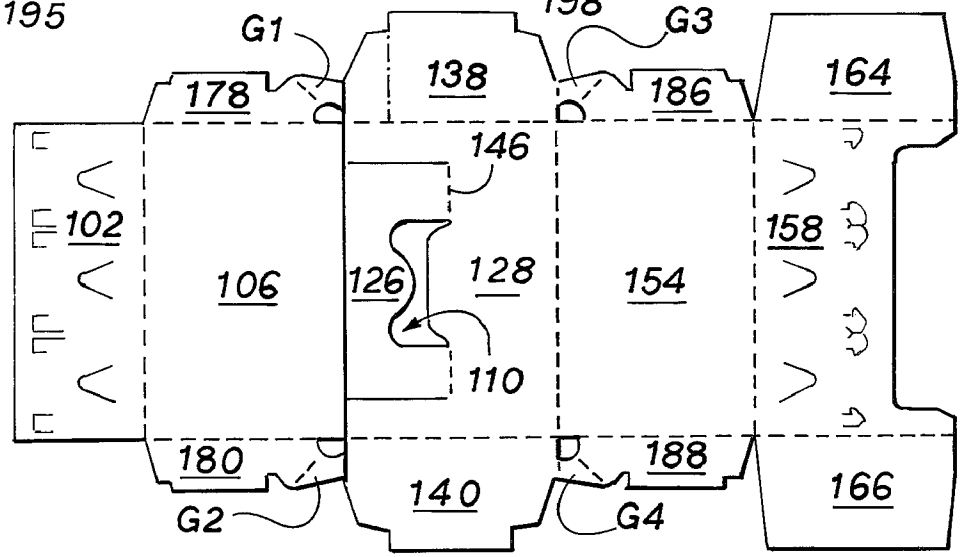
FIG. 2 is a plan view of the blank of FIG. 1 in a pre-glued condition prior to loading and completely erecting the carton.

Erecting of the carton 300 to the condition shown in FIG. 3 is preferably performed in two phases, any part of either of which can be performed automatically or manually. In the first phase, the blank 100 is partially configured as shown in FIG. 2 into a condition suitable for loading in an automatic packaging machine. Thus, the first phase involves pre-gluing or otherwise securing the inner, outer, and intermediate top panels 110, 128, 114 to form the top wall 302 and the composite handle panel H. In the exemplary embodiments, glue or other adhesive is applied to the outside surface of intermediate top panel 114. Intermediate top panel 114 is folded about fold line 112 until the outside surface thereof is in face contacting relationship with a portion of the outer surface of inner top panel 110. The outside surface of handle panel 116 is preferably not secured to the outer surface of inner top panel 110. Adhesive is also applied to the inside surface of outer top panel 128 and to the inside surface of the handle panel 126. Adhesive is further applied to the outside surfaces of end tabs 190, 191. Outer top panel 128 along with handle panel 126 are folded about fold line 124 until the inside surfaces thereof are secured in a face contacting relationship with the corresponding portion of the inside surfaces of intermediate top panel 114, handle panel 116 and with the corresponding portions of the outside surface of inner top panel 110. The outer surfaces of end tabs 190, 191 are secured to the inside surfaces of respective upper end wall panels 138 and 140. The carton 300 is now in the configuration shown in FIG. 2, and is ready to be loaded with articles and sealed.

Figure 6:
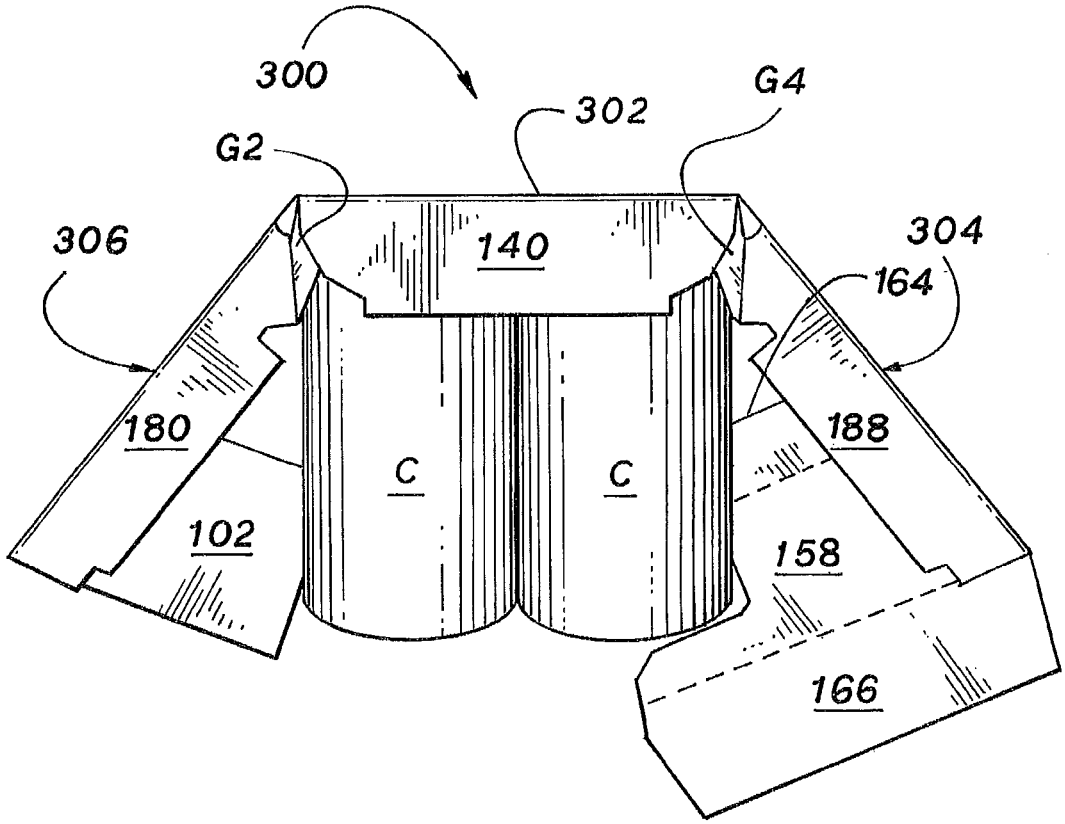
FIG. 6 is a perspective view of the pre-glued blank of FIG. 2 as it is wrapped around a group of articles.

The second phase involves wrapping the carton 300 around an article or group of articles, as shown in FIG. 6, and securing all the panels together to form carton walls. Referring again to FIG. 3, top wall 302 is pre-glued or otherwise assembled in the first phase as described above. The exemplary article group includes several beverage cans C, although the carton 300 may enclose any suitable articles such as bottles, juice boxes, candles, and the like. When viewed from above, the articles are arranged on ends in a matrix configuration having one or more rows with one or more articles in each row. For instance, FIG. 6 shows a configuration with two articles in each row. It is contemplated that the article group may include multiple tiers of articles with each tier possibly, but not necessarily, being separated such as by a partition. Thus, the articles may also be arranged in several vertical columns. The embodiment shown in the figures is a carton configured to enclose six beverage cans C in a single tier having three rows with two cans in each row (a 2×3 arrangement).

The inside surface of the top wall 302 is positioned above or atop the exemplary article group that is to be enclosed. The side walls 304, 306 formed from respective side panels 106, 154 are folded downwardly along respective fold lines 108, 152. The bottom panels 102, 158 are brought together under the group of cans C, which may have been conveyed to rest on a narrowed rail or support that enables machinery to fold the bottom panels 102, 158 along respective fold lines 104, 156 to contact the bottom surfaces of the cans C. The false apertures 168 can be engaged and used to align the retaining tabs 170 with locking tabs 172, which are pushed up and through the retaining tab apertures. The retaining tabs 170 are thrust aside by the locking tabs 172 and then fold back downward to some extent to brace the locking tabs 172. In this manner, bottom panels 102, 158 form bottom wall 312.

End wall 310 is formed by securing lower end wall panel 166 to upper end wall panel 140 in an overlapping arrangement. Side flaps 180, 188 are folded inwardly toward the interior of the carton 300, typically by means of folder wheels and guides. Since the side flaps 180, 188 are connected to upper end wall panel 140 via gussets G2, G4 and end tab 191, this inward folding causes the upper end wall panel 140 to fold downwardly and inwardly as well. Adhesive or other securing means may be applied to the outside surfaces of side flaps 180, 188. The packaging machine may include a bottom panel folder wheel or other folding device that then folds the lower end wall panel 166 upwardly and inwardly toward the interior of the carton 300 until at least a portion of its inside surface contacts at least a portion of the outside surface of upper end wall panel 140. Adhesive applied to at least one of the overlapping portions of the end wall panels 140, 166 secures the overlapping arrangement. End walls 308, 310 are substantially identical, so formation of end wall 308 is effected in the same manner and will not be further described.

Once the carton 300 is fully erected as shown in FIG. 3, the top wall 302 provides at least two layers of material along at least a portion of each of the four edges defined by fold lines 108, 148, 150, 152. The four edges provide four corners, which are each defined by the intersection of the top wall 302 and the respective one of the side and end walls 306, 308, 310, 304. More specifically, the top wall 302 provides three layers of material substantially entirely along the fold line 152, two or three layers of material entirely along each of the fold lines 148, 150 and two layers of material along portions of the fold line 108. When the handle H is in a lowered position, there are three layers of material along the corresponding portion of the fold line 108. Thus, the handle H provides reinforcement to the top wall 302 which is particularly advantageous when stacking cartons.

As shown in FIG. 4, when stacking and space conservation is no longer needed, the composite handle H can be raised to an upright position substantially normal to the plane of the top wall to facilitate carrying. As mentioned above, severance lines 142, 144 may be precut or may require tearing to raise the composite handle H.

Figure 5:
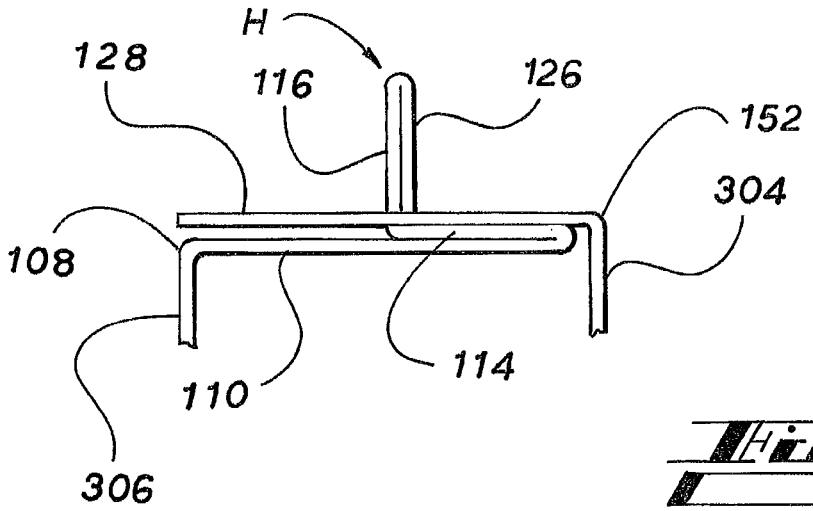
FIG. 5 is an exaggerated side view showing the relational positions of the respective layers of the top wall of the fully erected carton with the composite handle in an upright position.

Even when the handle H is raised, the top wall 302 provides at least two layers of carton material along at least a portion of all four edges. This is best shown in FIGS. 4 and 5 which demonstrate that when the handle H is upright: portions of the edge 108 are reinforced by the portions of outer top panel 128 that also lie along fold lines 148, 150; edges 148, 150 are reinforced from below by inner top panel 110, a portion of each edge 148, 150 being doubly reinforced by intermediate top panel 114; and, the entire edge 152 is doubly reinforced by inner top panel 110 and intermediate top panel 114. It should be noted that FIG. 5 is a greatly exaggerated representation of the relationship between the panels 110, 114, 128 that is not to scale, and is intended merely to aid in teaching implementation of the invention.

As used herein, directional references such as "top", "base", "bottom", "end", "side", "inner", "outer", "inside", "outside", "upper", "middle", "lower", "front" and "rear" do not limit the respective walls of the carton to such orientation, but merely serve to distinguish these walls from one another. Any reference to hinged connection should not be construed as necessarily referring to a junction including a single hinge only; indeed, it is envisaged that hinged connection can be formed from one or more potentially disparate means for hingedly connecting materials.

The above-described embodiments are merely exemplary illustrations of implementations set forth for a clear understanding of the principles of the invention. Variations, modifications, and combinations may be made to the above-described embodiments without departing from the scope of the claims. For example, those skilled in the art will appreciate that the packaging machine referenced herein represents only one example of the various packaging machine types and configurations that will be suitable for implementation of the various embodiments of the invention.

As another example, the composite handle H is described as including an opening that serves as a handhold. The handhold may have any suitable shape, size, or contour and may include flaps or other means for cushioning the user's fingers from the raw edges 134, 136. However, the composite handle H may be formed in any shape that lends itself to being easily gripped, such as a T-shaped handle. As yet another example, the bottom wall 312 may be formed from a bottom panel and an edge flap rather than from two bottom panels 102, 158.

All such variations, modifications, and combinations are included herein by the scope of this disclosure and the following claims.

What is claimed is:

1. A carton, comprising:

a bottom wall including first and second secured bottom panels;

first and second side walls hingedly connected to said first and second bottom panels respectively; and a top wall, comprising:

an inner top panel hingedly connected to said first side wall so as to form a first corner between said first side wall and said top wall;

an outer top panel hingedly connected to said second side wall so as to form a second corner between said second side wall and said top wall;

an intermediate top panel hingedly connected to said inner top panel and to said outer top panel;

a first handle panel formed from said intermediate top panel and hingedly connected to another portion of said intermediate top panel; and a second handle panel formed from and struck from said outer top panel and hingedly connected to another portion of said outer top panel, wherein said intermediate top panel is disposed between said inner top panel and said outer top panel.

2. The carton of claim 1, further comprising first and second end walls hingedly connected to said outer top panel so as to form third and fourth corners between said respective first and second end walls and said top wall.

3. The carton of claim 2, wherein at least a portion of said intermediate top panel extends substantially to the third and fourth corners.

4. The carton of claim 2, further comprising:

first and second side flaps, each being hingedly connected to an opposing edge of said first side wall;

third and fourth side flaps, each being hingedly connected to an opposing edge of said second side wall;

two end tabs, each being hingedly connected to an opposing edge of said inner top panel;

first and second gussets, each hingedly connecting one of said first and second side flaps to one of said end tabs; and third and fourth gussets, each hingedly connecting one of said third and fourth side flaps to one of said end walls.

5. The carton of claim 4, wherein:

the outside surface of each of said end tabs is secured to the inside surface of said end wall in a face contacting arrangement;

the inside surface of at least a portion of each of said first and second gussets substantially contacts the inside surface of one of said end tabs in a face contacting arrangement;

the inside surface of at least a portion of each of said third and fourth gussets substantially contacts the inside surface of said end wall in a face contacting arrangement;

the outside surface of at least a portion of each of said first, second, third, and fourth gussets substantially contacts the outside surface of one of said side flaps.

6. The carton of claim 1, wherein the inside surface of said outer top panel is secured to the inside surface of said intermediate top panel in a face contacting relationship, such that the inside surface of said first handle panel is secured to the inside surface of said second handle panel in a face contacting relationship, thereby forming a composite handle.

7. The carton of claim 1, wherein at least a portion of the outside surface of said inner top panel is secured to at least a portion of the outside surface of said intermediate top panel in a face contacting arrangement.

8. The carton of claim 1, wherein at least a portion of the outside surface of said inner top panel is secured to an overlapping portion of the inside surface of said outer top panel in a face contacting arrangement.

9. The carton of claim 6, wherein said composite handle is foldable to an upright position with respect to the plane of said top wall.

10. A blank, comprising:

a first bottom panel;

a first side panel hingedly connected to said first bottom panel;

an inner top panel hingedly connected to said first side panel;

an intermediate top panel hingedly connected to said inner top panel;

an outer top panel hingedly connected to said intermediate top panel;

a second side panel hingedly connected to said outer top panel;

a second bottom panel hingedly connected to said second side panel;

a first handle panel integral to said intermediate top panel; and a second handle panel integral to said outer top panel;

wherein said first handle panel is hingedly connected to said second handle panel along the hinged connection between said intermediate top panel and said outer top panel.

11. The blank of claim 10, wherein the length and width of the inner top panel are substantially the same as the length and width of the outer top panel.

12. The blank of claim 10, further comprising:

first and second upper end wall panels hingedly connected to said outer top panel;

first and second side flaps, each being hingedly connected to an opposing edge of said first side wall;

third and fourth side flaps, each being hingedly connected to an opposing edge of said second side wall;

two wall tabs, each being hingedly connected to an opposing edge of said inner top panel;

first and second gussets, each hingedly connecting one of said first and second side flaps to one of said end tabs; and third and fourth gussets, each hingedly connecting one of said third and fourth side flaps to one of said upper end wall panels.

13. A package, comprising:

a plurality of articles arranged in a plurality of rows; and a carton enclosing said articles, comprising:

a bottom wall for supporting said articles, said bottom wall including first and second secured bottom panels;

first and second side walls hingedly connected to said first and second bottom panels respectively; and a top wall, comprising:

an inner top panel hingedly connected to said first side wall so as to form a first corner between said first side wall and said top wall;

an outer top panel hingedly connected to said second side wall so as to form a second corner between said second side wall and said top wall;

an intermediate top panel hingedly connected to said inner top panel and to said outer top panel;

a first handle panel formed from said intermediate top panel and hingedly connected to another portion of said intermediate top panel; and a second handle panel formed from and struck from said outer top panel and hingedly connected to another portion of said outer top panel, wherein said intermediate top panel is disposed between said inner top panel and said outer top panel.

14. The package of claim 13, wherein the length and width of the inner top panel are substantially the same as the length and width of the outer top panel.

15. The package of claim 13, further comprising first and second end walls hingedly connected to opposing edges of said bottom wall so as to form third and fourth corners between said respective first and second end walls and said top wall.

16. The package of claim 15, wherein at least a portion of said intermediate panel extends substantially to the third and fourth corners.

17. The package of claim 15, further comprising:

first and second side flaps, each being hingedly connected to an opposing edge of said first side wall;

third and fourth side flaps, each being hingedly connected to an opposing edge of said second side wall;

two end tabs, each being hingedly connected to an opposing edge of said inner top panel;

first and second gussets, each hingedly connecting one of said first and second side flaps to one of said end tabs; and third and fourth gussets, each hingedly connecting one of said third and fourth side flaps to one of said end walls.

18. The package of claim 17, wherein:

the outside surface of each of said end tabs is secured to the inside surface of said end wall in a face contacting arrangement;

the inside surface of at least a portion of each of said first and second gussets substantially contacts the inside surface of one of said end tabs in a face contacting arrangement;

the inside surface of at least a portion of each of said third and fourth gussets substantially contacts the inside surface of said end wall in a face contacting arrangement;

the outside surface of at least a portion of each of said first, second, third, and fourth gussets substantially contacts the outside surface of one of said side flaps.

19. The package of claim 13, wherein the inside surface of said outer top panel is secured to the inside surface of said intermediate top panel in a face contacting relationship, such that the inside surface of said first handle panel is secured to the inside surface of said second handle panel in a face contacting relationship, thereby forming a composite handle.

20. The package of claim 13, wherein at least a portion of the outside surface of said inner top panel is secured to at least a portion of the outside surface of said intermediate top panel in a face contacting arrangement.

21. The package of claim 13, wherein at least a portion of said inner top panel is secured to a portion of the inside surface of said outer top panel in a face contacting arrangement.

22. The package of claim 19, wherein said composite handle is foldable to an upright position with respect to the plane of said top wall.

23. A carton comprising a composite top wall formed from at least three overlapping layers of panel material and a carrying handle structure formed from at least two of said overlapping layers, said at least three overlapping layers being arranged in series when the carton is in blank form, wherein said at least three overlapping layers of panel material comprise an inner top panel, an intermediate top panel, and an outer top panel, wherein said intermediate top panel is disposed between said inner top panel and said outer top panel, wherein said carrying handle structure comprises a first handle panel formed from said intermediate panel and a second handle panel formed from said outer top panel, and wherein a portion of said intermediate top panel and said first and second handle panels are interposed and connect between said inner top panel and portion of said outer top panel when the carton is in blank form.

24. The carton of claim 1, wherein said first and second handle panels are secured together in a face contacting relationship to provide a composite handle by which the carton can be lifted.

25. The carton of claim 1, wherein said first and second bottom panels are secured together by locking and retaining tabs.

26. The carton of claim 7, wherein said at least a portion of the outside surface of said inner top panel is glued to said at least a portion of the outside surface of said intermediate top panel.

27. The carton of claim 8, wherein said at least a portion of the outside surface of said inner top panel is glued to said overlapping portion of the inside surface of said outer top panel.

28. The blank of claim 10, wherein said intermediate top panel and said first and second handle panels are interposed and connect between said inner and outer top panels.

29. The carton of claim 23, wherein said first and second handle panels are formed from said inner and outer top panels respectively, said second handle panel being hingedly connected to said outer top panel along a fold line.

30. The carton of claim 23, wherein at least a portion of the outside surface of said inner top panel is secured to at least a portion of the outside surface of said intermediate top panel in a face contacting arrangement.

31. The carton of claim 23, wherein at least a portion of the outside surface of said inner top panel is secured to an overlapping portion of the inside surface of said outer top panel in a face contacting arrangement.

* * * * *